US005373666A

United States Patent [19]

Quintilio

[11] Patent Number: 5,373,666

[45] Date of Patent: Dec. 20, 1994

[54] GRINDING WHEELS FOR THE MACHINE WORKING OF MARBLE AND GRANITE

[76] Inventor: Lupi Quintilio, Via Flaminia, 138, 00068 IT Rignano Flaminio, Roma, Italy

[21] Appl. No.: 35,488

[22] Filed: Mar. 22, 1993

Related U.S. Application Data

[63] Continuation of Ser. No. 765,681, Sep. 26, 1991, abandoned.

[30] Foreign Application Priority Data

Sep. 26, 1990 [IT] Italy ..... 48308 A/90

[51] Int. Cl.[5] ..... B24B 9/08

[52] U.S. Cl. ..... 451/241; 125/11.01; 451/541; 451/438

[58] Field of Search ..... 51/80 R, 88, 89, 165.74, 51/165.76, 165.77, 72 R, 102, 205 WG, 206 R, 206 NF, 206.4, 207, 209 R, 210, 214, 241 G, 283 E, 284 E; 125/11.01, 11.03, 11.04

[56] References Cited

U.S. PATENT DOCUMENTS

| | | | |
|---|---|---|---|
| 129,395 | 7/1872 | Connel | 51/206 R |
| 2,327,407 | 8/1943 | Edyvean . | |
| 2,772,520 | 12/1956 | Jaye | 51/216 R |
| 3,057,121 | 10/1962 | Buchi | 51/102 |
| 3,299,582 | 1/1967 | Kohlstrunk | 125/11.03 |
| 3,841,033 | 10/1974 | Appleby | 51/165.91 |
| 3,946,527 | 3/1976 | Beer | 51/281 R |
| 4,611,438 | 9/1986 | Siden | 51/206 R |
| 4,658,800 | 4/1987 | Larsson | 125/11.03 |
| 4,977,709 | 12/1990 | Siden | 51/206 R |
| 5,058,562 | 10/1991 | Tsutsui | 125/11.03 |

FOREIGN PATENT DOCUMENTS

| | | | |
|---|---|---|---|
| 536644 | 5/1922 | France | 51/125 |
| 2211865 | 3/1972 | Germany | 51/284 E |
| 1596567 | 8/1981 | United Kingdom | 51/283 E |
| 1542785 | 2/1990 | U.S.S.R. | 51/283 E |

*Primary Examiner*—Maurina T. Rachuba

*Attorney, Agent, or Firm*—Watson, Cole, Grindle & Watson

[57] ABSTRACT

A shaped diamond wheel, at certain height, determined by both the type of grinding wheel which is being used and the working stage, is provided with a rotating feeling pin, consisting of a metal element a few millimeters high which projects for few hundreths of a millimeter with regard to the shape of grinding wheel. The rotating feeling pin does not interfere with the working of stone, with the exception of very small portion of stone which come into contact with the rotating feeling pin.

8 Claims, 1 Drawing Sheet

Fig. 1.
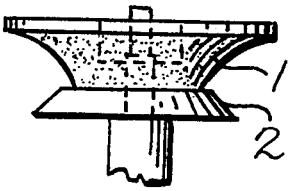
Fig. 2.
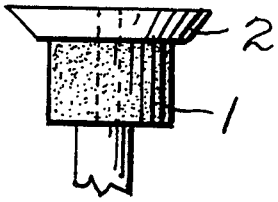
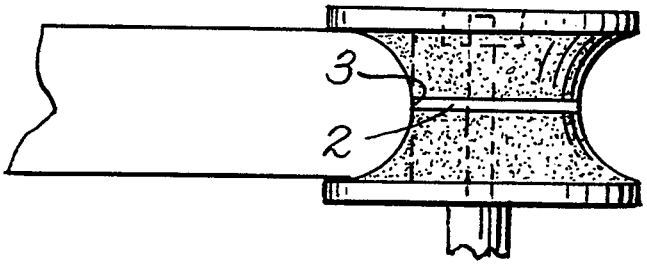
Fig. 3.
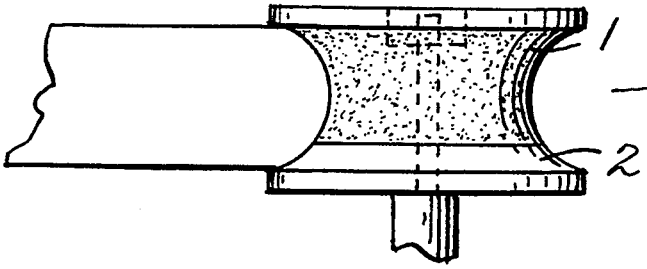
Fig. 4.
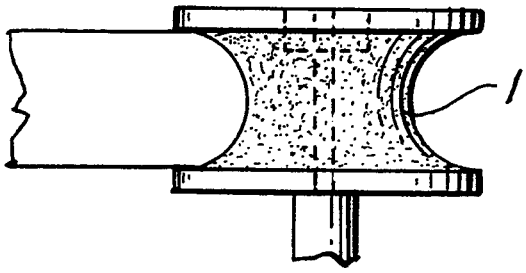
Fig. 5.
Fig. 6.
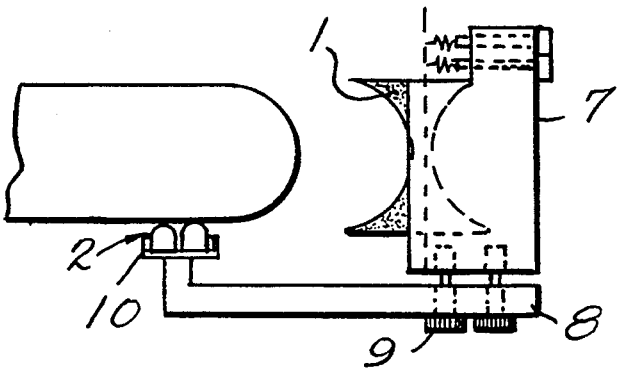

GRINDING WHEELS FOR THE MACHINE WORKING OF MARBLE AND GRANITE

This is a continuation of application Ser. No. 07/765,681 filed Sep. 26, 1991 now abandoned.

BACKGROUND OF THE INVENTION

It is a well known fact that there are various types and sizes of chamfering machine tools currently on the market; for example, there are expensive and complex machines the structures of which allow the installation of a frame, on which the wood or steel template is fixed, which faithfully reproduces the desired shape. Beside being costly and taking up a lot of floor space, these machines also entail a lot of hard work for the construction of the necessary templates.

Smaller machines, also on the market, have been created, but these do not guarantee the execution of a perfect job.

Their major shortcoming is that, not being provided with a template of the desired shape, work is accomplished simply by the machine tool's travel end. This does not always allow the desired degree of perfection.

SUMMARY OF THE INVENTION

The object of this invention is to provide a specific grinding wheel, which may also be applied to machine tools currently on the market, which remedies the abovementioned shortcomings and, in particular, gives the possibility of working with a portable or work-table chamfering tool without having to provide a shape each time it has to be used.

The grinding wheel consists of diamond wheel shaped in such a way as to achieve the desired shape during the machine working. It is divided, cross-wise, into two portions separated by a rotating feeling pin.

The feeling pin slightly projects for several hundreths of a millimeter with regard to the internal shape outlined by the two portions of the diamond wheel. Thus when the piece comes into contact with the rotating feeling pin during machine working, the two portions of the grinding wheel run idly, thus terminating their function.

In order to allow the perfect machine working of the piece of stone, the device is also provided with another feeling pin, installed on adjustable rotating balls, which allows all kinds of machine operations. These operations range from the grinding of curved slabs to the shaping of toroidal or other kinds of outline, with subsequent honing and polishing.

BRIEF DESCRIPTION OF THE DRAWING

For a better understanding of the foregoing brief summary a more detailed description follows, making reference to the specified illustrations wherein:

FIG. 1 shows a side view of a diamond wheel according to the present invention.

FIG. 2 shows a cylindrical diamond wheel according to the present invention.

FIG. 3 shows a diamond wheel for shaping according to the present invention.

FIG. 4 shows a diamond wheel for honing according to the present invention.

FIG. 5 shows a diamond wheel for polishing according to the present invention.

FIG. 6 shows a feeling pin with rotating balls according to the present invention.

DETAILED DESCRIPTION OF THE PREFERRED EMBODIMENTS

The grinding wheel works in the following manner. During the machine working of a slab of marble, for example, which needs to be cut along a non-linear profile, normal machines require the use of a template which faithfully reproduces the shape to be obtained. The template is usually made of wood. The template guides the machine so that the slab of marble is cut according to the desired shape. Such a procedure is not cost effective for small jobs, because it is necessary to prepare a template for each piece.

The grinding wheel of the present invention does not require any template in order to obtain a certain shape because it abrades a piece of marble only up to a certain depth. This is accomplished by a rotating feeling pin. In the embodiment shown in FIG. 3, the feeling pin is inserted between two parts of the grinding wheel, each part comprising an grinding surface. In the embodiments shown in FIGS. 1, 2 and 4, the feeling pin is not disposed between two parts of the grinding wheel but rather adjacent a grinding wheel.

At the beginning of the machine work, the grinding wheel abrades and shapes a piece. According to the embodiment shown in FIG. 3, the feeling pin is placed in between the two grinding surfaces. During the beginning of machine work, the rotation of the grinding surfaces is translated to rotational movement of the feeling pin. When the shape of the piece to be machined coincides with the shape of the grinding wheel, the rotating feeling pin prevents the grinding wheel from abrading any further, that is, it prevents the grinding surfaces from cutting the stone any deeper. The rotating feeling pin acts as a stop between the machined piece and the grinding wheel. The wheels are not able to abrade the stone deeper than the depth allowed by the feeling pin. This makes it possible to eliminate the template required by normal marble cutting machines.

The depth feeling pin shown in FIG. 6 is used with the chafing wheel shown in FIG. 2 and its job is to keep the bevel of the wheel close to the bevel of the piece of stone. The chafing wheel is used to correct vertical profile showing irregularities.

The feeling pin may or may not protrude from the grinding surfaces of the grinding wheel. If the pin does protrude, it is only for a few hundredths of a millimeter, in order to make sure that when the machined piece touches the pin there is no further abrasion. When the piece begins contacting the feeling pin, the piece can no longer advance toward the wheel. When the feeling pin comes into contact with the machined piece, the grinding wheel does not have to stop rotating but the abrading surfaces of the grinding wheel can no longer reach the stone to abrade it.

With reference to the above figures, the grinding wheels specified in this invention consist of a shaped diamond wheel (1) which, at a certain height determined by both the type of grinding wheel which is being used and the stage of machine working, is provided with a rotating feeling pin (2).

The rotating travel limiting member (2) consists of a metal element, having a thickness of a few millimeters and which is suitable for the function it has to fulfill. The element projects a few hundredths of a millimeters with regard to the contour of the grinding wheel.

The rotating travel limiting member, therefore, does not influence the machine working of the stone until it is nearly finished. In fact, only when the outline of the stone coincides exactly with the outline of the grinding wheel adds a small part of the stone (3) come into contact with the rotating travel limiting (2). The contact member between the travel limiting member and the stone prevents the upper and lower parts of the grinding wheel from carrying out their task, thus ending the first step of the machine working.

Obviously, during this first step of the working, a small portion of un-machined stone will remain under the travel limiting member, this will be completed by another specific grinding wheel, such as the one shown in FIG. 4 which features a travel limiting member (2) located in a different position, with regard to the previous grinding of FIG. 3, thus allowing the partially unworked stone to be finished.

As may be seen from the Figures, besides being easily perceived, the grinding wheels may have different shapes, so as to be able to execute all the various possible working stages.

For example, the grinding wheel shown in FIG. 1 is particularly recommended for grinding and carrying out the so-called "owl's beak" shape.

The grinding wheel shown in FIG. 2 is useful for grinding a slab to be treated.

FIG. 5 shows an extremely fine grained grinding wheel, as you may easily see, without the rotating feeling pin and which is especially useful for polishing and finishing the previously machined piece.

In order to fix and to maintain the working depth of the piece as precisely as possible, another feeling pin, mounted on wheels 10 and which is shown in FIG. 6, has been devised. This consists of a body (7) to which the machine tool is fixed. The body (7) is provided with a square (B) which has specific adjusting screws (9) on one side and on the opposite side, small rotatable balls (10), which allow the machine to slide easily along the underside of the slab.

The foregoing invention may undergo all and any modifications, suggested by the practical employment of the tool and by expert technicians, without going beyond the invention defined in the following claims.

I claim:

1. A grinding system for forming a product having a finished contour, said grinding system comprising a stone working shaping device and a stone working honing device, said shaping device, comprising:

a first shaping wheel rotatable about a central axis thereof, said first shaping wheel having a contoured shaping surface for shaping the outer surface of a stone; and first travel limiting means rotatable about a central axis thereof and being separate from but adjacent to said first shaping wheel, said first travel limiting means having a non-abrasive surface for contacting a stone to be machine worked by said shaping device only when an outline of the stone coincides with the contour of the shaping device, said first travel limiting means contacting a stone at a first location and preventing relative movement of the shaping device and the stone towards one another when contact between the first travel limiting means and the stone occurs at said first location and thereby leaving an unworked portion at said first location;

said honing device having the same contour as said shaping device and comprising:

a honing wheel rotatable about a central axis thereof and having a contoured honing surface for honing the outer surface of a stone; and second travel limiting means rotatable about a central axis thereof and being separate from but adjacent to said honing wheel; said second travel limiting means having a non-abrasive surface for contacting a stone to be machine worked by said honing device only when an outline of the stone coincides with the contour of the honing device, said second travel limiting means contacting a stone at a second location and preventing relative movement of the honing device and the stone towards one another when contact between the second travel limiting means and the stone occurs at said second location, said second location being different from said first location so that said honing surface machine works said first location to provide a final contour at said first location.

2. A system as in claim 1, wherein said shaping device comprises a second shaping wheel rotatable about a central axis thereof, said second shaping wheel having a contoured shaping surface for shaping the outer surface of a stone, said first travel limiting means being disposed between said first shaping wheel and said second shaping wheel.

3. A system as in claim 1, further comprising a polishing wheel rotatable about a central axis thereof and having the same contour as said shaping device, said polishing wheel having a polishing surface for polishing the outer surface of a stone.

4. A stone working device comprising a body, a grinding wheel rotatably mounted on said body for rotation about a central axis thereof, means for moving said body in a direction substantially perpendicular to said axis of rotation and toward a stone to be machine worked, and travel limiting means connected to said body for movement with said body to limit movement of said body toward a stone to be worked, said grinding wheel having a contoured grinding surface for grinding the outer surface of a stone, said travel limiting means comprising small rotatable balls which allow the body to be guided along the contour of a stone, said travel limiting means being separated from said grinding wheel and preventing advancement of the body and grinding wheel toward a stone to be machine worked when said travel limiting means are prevented from further traveling along the contour of a stone.

5. A stone working device as in claim 4, wherein said travel limiting means are adjustably positioned with respect to said body.

6. A stone working device as in claim 4, wherein said travel limiting means is aligned at a 90° angle with respect to the longitudinal axis of said body.

7. A stone working device as in claim 4, wherein said travel limiting means are connected to said body by a square.

8. A stone working device as in claim 7, wherein said square has adjusting screws to adjust the position of said travel limiting means with respect to said body.

* * * * *

UNITED STATES PATENT AND TRADEMARK OFFICE

CERTIFICATE OF CORRECTION

PATENT NO. : 5,373,666

DATED : December 20, 1994

INVENTOR(S) : Quintilio LUPI

It is certified that error appears in the above-indentified patent and that said Letters Patent is hereby corrected as shown below:

On the title page: Item

[76] Inventor: Quintilio Lupi, Via Flaminia, 138, 00068 IT Rignano Flaminio, Roma, Italy Also, in the upper left-hand corner of the patent, the heading should read:

United States Patent [19]

Lupi

Signed and Sealed this

Fourth Day of April, 1995

Bruce Lehman

*Attest:*

BRUCE LEHMAN

*Attesting Officer*

*Commissioner of Patents and Trademarks*